US006274000B1

(12) United States Patent
Koivukunnas et al.

(10) Patent No.: US 6,274,000 B1
(45) Date of Patent: Aug. 14, 2001

(54) METHOD AND DEVICE IN THREADING OF PAPER WEB

(75) Inventors: Pekka Koivukunnas, Järvenpää; Kari Salminen, Kellokoski, both of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/424,308

(22) PCT Filed: May 25, 1998

(86) PCT No.: PCT/FI98/00433

§ 371 Date: Nov. 22, 1999

§ 102(e) Date: Nov. 22, 1999

(87) PCT Pub. No.: WO98/54407

PCT Pub. Date: Dec. 3, 1998

(30) Foreign Application Priority Data

May 27, 1997 (FI) ..... 972228

(51) Int. Cl.[7] ..... D21F 7/00

(52) U.S. Cl. ..... 162/193; 162/194; 162/195; 162/280; 162/111; 162/286; 162/310; 226/7; 226/91; 34/120

(58) Field of Search ..... 162/193, 194, 162/286, 310, 361, 111, 196, 109, 280–281; 34/114, 117, 120; 226/7, 12, 91, 97.3; 83/53, 177, 922, 614, 764; 264/282–283; 156/183; 493/442–443, 408, 217

(56) References Cited

U.S. PATENT DOCUMENTS

| | | | | |
|---|---|---|---|---|
| 4,440,597 | | 4/1984 | Wells et al. | 162/111 |
| 4,648,942 | | 3/1987 | Wanke et al. | 162/286 |
| 5,445,055 | * | 8/1995 | Koponen et al. | 83/53 |
| 5,571,381 | * | 11/1996 | Vessari et al. | 162/195 |
| 5,600,897 | * | 2/1997 | Sollinger et al. | 34/115 |
| 5,622,601 | * | 4/1997 | Adams et al. | 162/194 |
| 5,718,058 | * | 2/1998 | Atzinger | 34/117 |
| 5,762,759 | * | 6/1998 | Wedel | 162/193 |
| 6,001,219 | * | 12/1999 | Caspar | 162/286 |
| 6,022,452 | * | 2/2000 | Caspar | 162/286 |
| 6,073,825 | * | 6/2000 | Hilker | 226/91 |

FOREIGN PATENT DOCUMENTS

| | | | | |
|---|---|---|---|---|
| 3924897 | | 2/1991 | (DE) . | |
| 72550 | | 2/1987 | (FI) . | |
| 89288 | | 5/1993 | (FI) . | |
| 2 647 049 | * | 5/1989 | (FR) | 162/194 |
| 91/03359 | * | 3/1991 | (WO) | 162/193 |
| 98/33974 | * | 8/1998 | (WO) | 162/193 |

* cited by examiner

*Primary Examiner*—Jose Fortuna
(74) *Attorney, Agent, or Firm*—Steinberg & Raskin, P.C.

(57) ABSTRACT

The invention relates to a method in a paper machine in threading of paper web, in which method a narrower tail (T) is separated from the edge of the paper web and transferred to threading guiding means arranged in connection with the moving parts of a machine conveying the paper web. Before transferring the tail (T) to the threading devices, its free length is shortened, for example by crinkling, wherein its tensile stretch is increased and bending stiffness reduced.

17 Claims, 1 Drawing Sheet

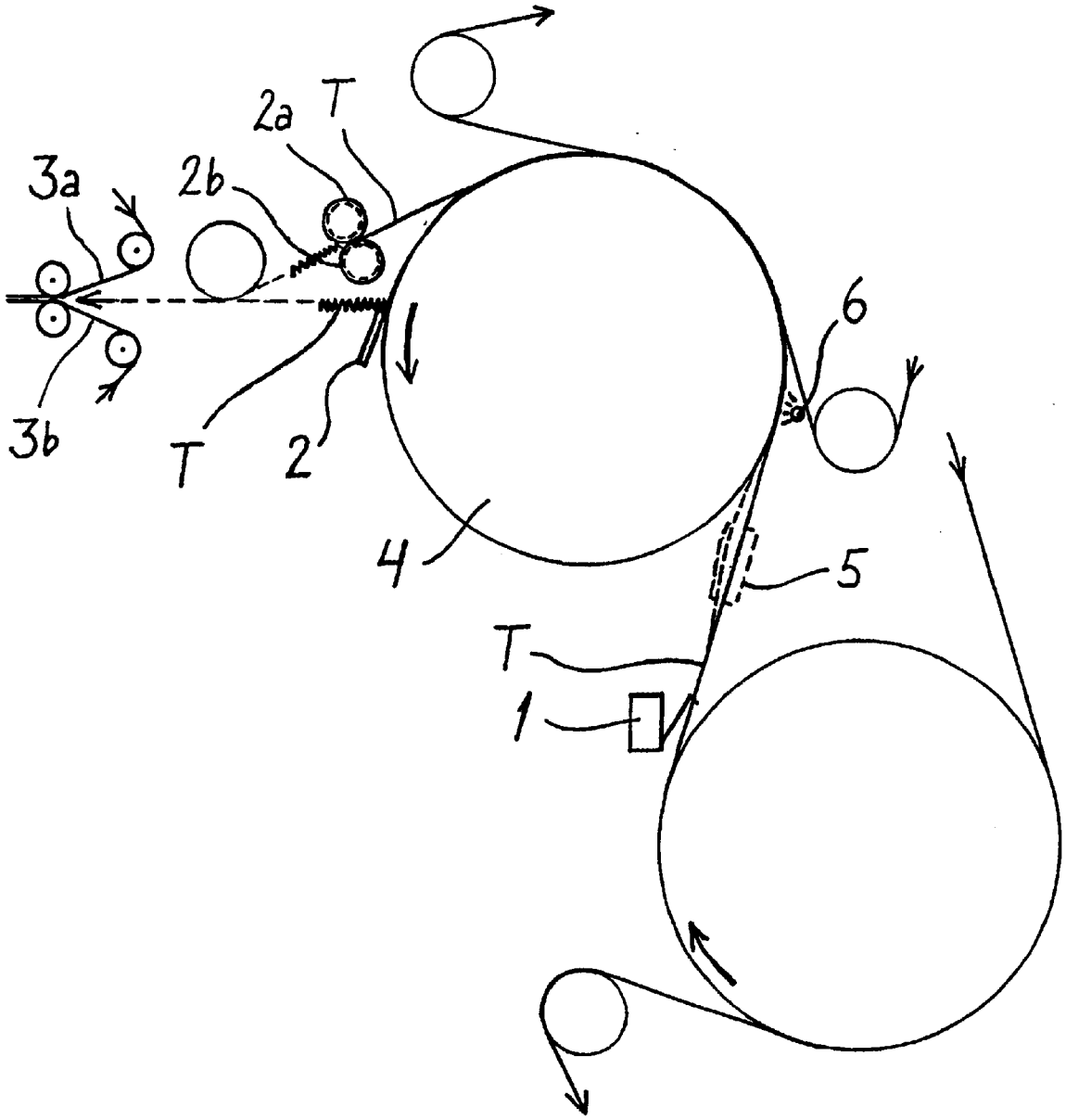
2a
T
3a
2b
6
3b
T
2
4
5
T
1

METHOD AND DEVICE IN THREADING OF PAPER WEB

FIELD OF THE INVENTION

The invention relates to a method in threading of paper web, which The present invention relates to a method for threading a tail section of a paper web into a paper machine and a device for implementing such method.

BACKGROUND OF THE INVENTION

When starting a paper machine after a stoppage or a web break, the paper has to be passed through the machine again. Thus, from the edge of the paper web, a narrow edge strip is separated, which is first run through the machine. When the edge strip is made to travel through the machine or part of the machine, it can be spread to a full-width web. There are various guide systems available to make the edge strip follow the path of paper web travel formed by cylinders and rolls. Generally, in that case, rope systems, so-called threading ropes, are used, which travel outside the web egde, the tail being guided in between the ropes.

On-line threading of the edge strip with fast-running paper machines (the speeds typically over 20 m/s, design speeds at present even 30 m/s) is a problem, especially if the line involves processing devices which require complicated transfers. It is difficult to guide a fast moving tail along the correct path. Similarly, the fact that the tail tends to break when it hits obstacles during its travel, poses a problem.

In addition to the conventional rope transfer, attempts have been made to solve the problem with different belt support devices, air blows, suction devices, etc. These devices do help to achieve successful threading in relatively straightforward and simple transfers, but e.g. for an on-line multinip calender they do not provide an adequate solution.

Thus, the tail plays an important role in the beginning of the production run of the paper machine, and its transfer must proceed without disturbance. The tail itself should be strong enough to sustain the mechanical stresses of web feeding and not to break for example when hitting obstacles. Especially in the edge zone of the paper web, the strength of the web is a problem also in other respects, and thus, to strengthen the tail, Finnish patent 72550 suggests feeding of auxiliary pulp on the edge area of the paper web for strengthening the edge strip and also for reducing the tendency of the paper web to break in the production run. This requires changes in the feeding of the pulp in the headbox, or a particular device for feeding the auxiliary pulp.

OBJECTS AND SUMMARY OF THE INVENTION

The purpose of the invention is to present a method for improving the threading properties of the edge strip without a need for special auxiliary pulp, wherein threading becomes more reliable. To attain this purpose, the method according to the present invention shortens the tail section of the paper web in a longitudinal direction prior to threading the same. By shortening the free length of the tail with mechanical working, the tail is provided with ideal properties with respect to the stresses and speeds involved in threading.

The device according to the present invention acts to shorten the tail section of the paper web in a longitudinal direction to thereby increase the strength and durability of the tail section. The device which shortens the tail structurally can be placed in a suitable location after a device for separating the tail before threading guiding means.

As for the other preferred embodiments of the invention, reference is made to the appended dependent claims and the description hereinbelow.

BRIEF DESCRIPTION OF THE DRAWINGS

In the following, the invention will be described in more detail with reference to the appended drawing, which shows a device according to the invention in a paper machine, in connection with the threading of paper web.

DETAILED DESCRIPTION OF THE INVENTION

The drawing shows the end of the drying section of a paper machine before the calender. The web arrives at the end of the drying section via a winding path defined by the drying cylinders, after which it is led to the calender with guide rolls. To guide the web through the following machine section, an approximately 15–50 cm wide tail T is separated from it with a diagonal cutter 1, which tail is formed of the edge zone of the web. This is guided forward with auxiliary means known as such in a gap between threading ropes 3*a*, 3*b*, and the rest of the web is guided to the pulper.

Between the diagonal cutter 1 and the threading ropes 3*a*, 3*b*, there is a device which shortens the original length of the tail by mechanical working. This device, denoted in the drawing with a reference number 2, is arranged to mechanically cause such a change in the structure of the tail that the tail is crinkled, i.e. transverse folds are created in it, bringing the parts of the tail closer to each other in the longitudinal direction. Thus, an increased tensile stretch (elongation at rupture) is obtained in the tail, wherein it does not break easily when hitting an obstacle, or being subjected to the effect of the draw of mechanical guiding means. In this context, the shortening of the tail refers to the change in length in contrast with the free lengths, the "rest lengths" of the tails, i.e. the lengths not subjected to tensile stress. In other words, the tail does not become shorter permanently, but it can be stretched for example into its original length or even beyond that, with a tension of suitable strength.

The advantages of the method include:

Applicability also in existing machines to enhance threading for example in coating sections, calenders and finishing devices in general.

The method does not utilize glues, adhesive tapes and other materials that increase risks/purification needs.

The method substantially improves the tear resistance of the tail and gives elasticity for removing speed differences, slacks, etc.

The speed of the threading ropes can be somewhat increased from the nominal one to remove slacks/bags, because the elasticity of the tail makes it possible.

Threading can be performed at a speed lower than the machine speed.

In practice, the device 2 is a device which is in contact with the tail T and mechanically works its structure in a way presented above. Devices effecting crinkling provide a good example of such a device. One sub-group of these are for instance crêping devices. The drawing illustrates three different alternatives, which will be described in the following.

In the first alternative, the device 2 is a release doctor located against the mantle of the last drying cylinder 4, and crinkling the tail T conveyed by the cylinder, wherein the tail T, when hitting the doctor, simultaneously disengages from the cylinder, and is guided to the threading devices 3*a* and 3*b*.

Another alternative is to use a crêping doctor at the same point to crinkle the tail by crêping. Crêping doctors are known as such, and here prior art, such as different doctor geometries and contact angles, can be utilized in connection with the actual paper crêping. Different crêping methods, for instance a crêping doctor located against the cylinder, are presented for example in U.S. Pat. No. 4,440,597.

As the third alternative, broken lines in the drawing illustrate a device 2 separate from the last drying cylinder 4, which device 2 is in contact with the tail T after the drying cylinder 4. The device is composed of two folding rolls 2*a* and 2*b*, between which the tail T travels, and which generate the aforementioned phenomena by mechanically working the tail. Consequently, the crinkling is achieved with the surface structure of the rolls and mantles, for example in such a way that one crinkling roll has a surface made of soft rubber or corresponding elastic material, and the other has a surface made of grooved, harder material, such as metal. The structures of the crinkling rolls can also resemble known fluting rolls.

In addition to the fact that the tensile stretch of the tail T increases after the device 2, and that it is more elastic to receive mechanical stresses resulting from the contact with threading devices, the invention provides one significant advantage still. Since the length of the tail T in a certain respect becomes shorter after the treatment, the speed is reduced respectively because the mass flow is constant. Consequently, it is possible to run all the moving parts located after the treatment point, also threading devices such as threading ropes, at a lower speed. This considerably facilitates the transfer of the tail T along the correct path.

For example by changing the degree of crinkling, it is possible to change the speed of the threading devices correspondingly. In fast-running machines, in which the highest production rates at present are approximately 26 m/s, it is thus possible to reduce the centrifugal forces and inertial forces acting on the tail after the treatment point.

It is also possible to influence the crinkling conditions with other variables, such as wetting and drying operations, e.g. IR drying operations. Wetting is necessary especially when crêping is used, and in the drawing the device wetting the tail T at the cylinder after the diagonal cutter is denoted with a reference number 6. These procedures need to be directed merely to the narrow tail T, wherein they do not require massive auxiliary devices.

In addition to the direct treatment of the tail T separated from the web, the invention can also be used for further treatment of such a tail which is separated from the web with conventional methods, and after that folded in its longitudinal direction. This invention is described in more detail in the parallel patent application (U.S. Ser. No. 09/423,360) of the applicant which was filed under 35 U.S.C. §371 based upon International Application PCT/FI98/00432 having an international filing date of May 25, 1998. In that case, there is a device before the treatment point, which is arranged to turn the other edge zone, or both edge zones of the tail T against the rest of the tail in such a way that a longitudinally extending fold is produced, and in the drawing the location of such a device 5 is schematically described with dashed lines. The device is located between the diagonal cutter 1 and the last drying cylinder 4, and it has a guiding surface, which in a contact to the other edge zone of the tail within a certain length of the same, gradually turns it towards the rest of the tail, and further it contains a surface which finally causes the turning of the edge zone against the tail, i.e. the folding of the tail. The tail can thereby be folded against the surface of the next drying cylinder 4, or ot can contain a special nip for this purpose before the drying cylinder. Folding increases the stregth of the tail, and with the finishing treatment according to the invention it is possible to remove bending stiffness from such a tail and to increase its tensile stretch and elasticity. When handling a folded strip it is possible to use the same, above-presented principles as when handling a single-ply strip.

It is possible to apply the invention also in other parts of the machine, wherein before new threading devices a location is arranged where a mechanical treatment similar to the one described above is performed on the tail, and the speed of the paper machine section following the treatment point can be reduced correspondingly for the duration of threading.

When starting to spread the paper web to the normal web width, the treatment is terminated, possibly by reducing it gradually in such a way that the tail T returns to the regular length, wherein the speed of the threading devices can also be gradually increased to the normal machine speed. After this, the web is spread to full width with a diagonal cutter, and a regular producion run can begin.

The invention is not restricted solely to the above-described treatment methods, but in it it is possible to use all possible mechanical treatment methods which produce the aforementioned changes in the tail and the advantages achieved therein.

Similarly, paper machine refers to all machines producing continuous webs from fibrous raw material, irrespective of the grammage, including board machines, as well as paper web finishing machines too. Correspondingly, paper web refers to all fibrous webs travelling in these machines.

What is claimed is:

1. Method in threading of paper web, in which method a narrower tail (T) is separated from the edge of the paper web and transferred to threading guiding means arranged in connection with the moving parts of a machine conveying the paper web, wherein before transferring the tail (T) to the threading devices, its free length is shortened in its longitudinal direction by means of a working action directed to the tail.

2. Method according to claim 1, wherein the section of the machine conveying the paper web after the treatment point of the tail (T) is run at a lower speed than the section preceding the same.

3. Method according to claim 1, wherein the tail (T) is worked by crinkling it.

4. Method according to claim 3, wherein said crinkling is performed by crêping.

5. Method according to claim 4, wherein said crinkling is performed with a crêping doctor against the surface of a cylinder.

6. Method according to claim 4, wherein said crêping is performed with a release doctor against the surface of a cylinder.

7. Method according to claim 3, wherein said crinkling is performed between two surfaces in contact with the tail.

8. Method according to claim 7, wherein said folding is performed between two rolls in contact with the tail.

9. Method according to claim 1, wherein said the speed of the threading devices is reduced below the threading speed applied to the untreated tail, according to the change in the longitudianal direction of the tail.

10. Method according to claim 1, wherein said mechanical working is directed to a tail (T) which is folded at a longitudinally extending folding line.

11. Device in threading of paper web for improving the properties of a tail (T), separated from the edge of the paper web, before guiding it to threading devices arranged in connection with the moving parts of a machine conveying the paper web, wherein the device (2) comprises means placed on the travel path of the tail (T) and arranged to work the tail in such a way that its free length becomes shorter.

12. Device according to claim 11, wherein in the machine conveying the paper web, the section after the means working the tail is arranged to run at a lower speed than the section preceding the same.

13. Device according to claim 11, wherein the means are arranged to crinkle the tail.

14. Device according to claim 13, wherein the means comprise of a release doctor and a surface of the cylinder conveying the tail (T), against which surface the release doctor is placed.

15. Device according to claim 13, wherein the means comprise of a crêping doctor and a surface of the cylinder conveying the tail (T), against which surface the crêping doctor is placed.

16. Device according to claim 13, wherein the means comprise of two crinkling surfaces effecting the working, between which the tail (T) is led.

17. Device according to claim 16, wherein the means comprise the surfaces of two opposite rolls (2*a*, 2*b*) between which the tail (T) is led.

* * * * *